US011008069B2

(12) United States Patent
Whitman

(10) Patent No.: US 11,008,069 B2
(45) Date of Patent: May 18, 2021

(54) TOWABLE DEVICE HAVING A COVER AND LOOPED TOW STRAP

(71) Applicant: Lucian D. Whitman, Lake Isabella, CA (US)

(72) Inventor: Lucian D. Whitman, Lake Isabella, CA (US)

( * ) Notice: Subject to any disclaimer, the term of this patent is extended or adjusted under 35 U.S.C. 154(b) by 39 days.

(21) Appl. No.: 16/449,311

(22) Filed: Jun. 21, 2019

(65) Prior Publication Data

US 2020/0398940 A1 Dec. 24, 2020

(51) Int. Cl.
*B63B 21/58* (2006.01)
*B63B 7/08* (2020.01)

(52) U.S. Cl.
CPC ..... *B63B 7/085* (2013.01); *B63B 21/58* (2013.01)

(58) Field of Classification Search
CPC ..... B63B 7/085; B63B 21/58; B63B 34/60
See application file for complete search history.

(56) References Cited

U.S. PATENT DOCUMENTS 3,871,042 A 3/1975 Farmer
4,635,581 A 1/1987 Scheurer
5,122,086 A * 6/1992 Remy ..... B63B 32/20 441/66
D393,683 S * 4/1998 Song ..... D12/316
6,010,381 A * 1/2000 Peterson ..... B62B 15/006 441/66
D464,390 S 10/2002 Hunter
6,648,707 B1 11/2003 Peterson
6,896,569 B1 5/2005 Wittenrich
D505,988 S 6/2005 Peterson
D510,971 S 10/2005 Hunter
8,523,621 B2 9/2013 Whitman

* cited by examiner

*Primary Examiner* — Stephen P Avila
(74) *Attorney, Agent, or Firm* — Nath, Goldberg & Meyer; Richard C. Litman

(57) ABSTRACT

The towable device having a cover and looped tow strap includes one or more toroidal inflatable tubes surrounded by an abrasion and puncture resistant cover. The cover tightly wraps around the inflated tube(s) to support and contain the tube(s). A top surface of the cover defines openings around the central passageway created by each toroidal tube to allow a rider to enter and occupy the space within the passageway. A lower surface of the cover provides a continuous surface to accommodate sliding during use and support a rider positioned within the center of each tube. A tow strap wraps around a circumference of at least one of the tubes within the cover and extends out a front of the cover for attachment to a towing device.

17 Claims, 3 Drawing Sheets

TOWABLE DEVICE HAVING A COVER AND LOOPED TOW STRAP

BACKGROUND

1. Field

The disclosure of the present patent application relates to recreational tubing, and particularly to a towable device having a cover and looped tow strap, the cover enclosing a plurality of inflatable tubes and including a tow strap, which wraps around the tube(s).

2. Description of the Related Art

Inflatable tubes for recreational use on water or snow may include many structures and designs, ranging from simple to complex. Since inflatable tubes are typically made of soft and easily damaged material, covers have been designed to protect the inflatable tube from punctures and abrasions.

In many cases, there is a desire to tow the tubes, whether it is behind a boat or up a snow-covered mountain. Current tubes attach a tow strap to the cover of the tube for attachment to a boat, sled, or similar towing mechanism. However, the strap exerts all of the towing force on the cover at its attachment point and relies upon the cover to transfer the force to move the inflatable tube and user. Accordingly, the point of attachment for the tow strap is subject to large amount of force and is prone to failure. This is especially the case when the cover is supporting multiple tubes and riders.

Thus, a towable device having a cover and looped tow strap solving the aforementioned problems is desired.

SUMMARY

The towable device having a cover and looped tow strap includes one or more toroidal inflatable tubes surrounded by an abrasion and puncture-resistant cover. The cover tightly wraps around the inflated tube(s) to support and contain the tube(s). A top surface of the cover defines openings around the central passageway created by each toroidal tube to allow a rider to enter and occupy the space within the passageway. A lower surface of the cover provides a continuous surface to accommodate sliding during use and to support a rider positioned within the center of each tube. A tow strap wraps around a circumference of at least one of the tubes, within the cover, and extends out a front of the cover for attachment to a towing device.

The towable device may be used for such activities as downhill sledding and water sports. When used for downhill sledding, the tow strap may be used for towing the tube and riding back up the hill. When used for water sports, the tow strap may be connected to a boat, which can tow the tube through the water.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The towable device having a cover and looped tow strap includes at least one toroidal inflatable tube surrounded by an abrasion and puncture-resistant cover. The cover tightly wraps around the inflated tube(s) to support and contain the tube(s). A top surface of the cover defines openings around the central passageway created by each toroidal tube to allow a rider to enter and occupy the space within the passageway. A lower surface of the cover provides a continuous surface to accommodate sliding during use and to support a rider positioned within the center of each tube. A tow strap wraps around a circumference of at least one of the inflatable tires within the cover, and extends out a front of the cover for attachment to a towing device.

Figure 1:
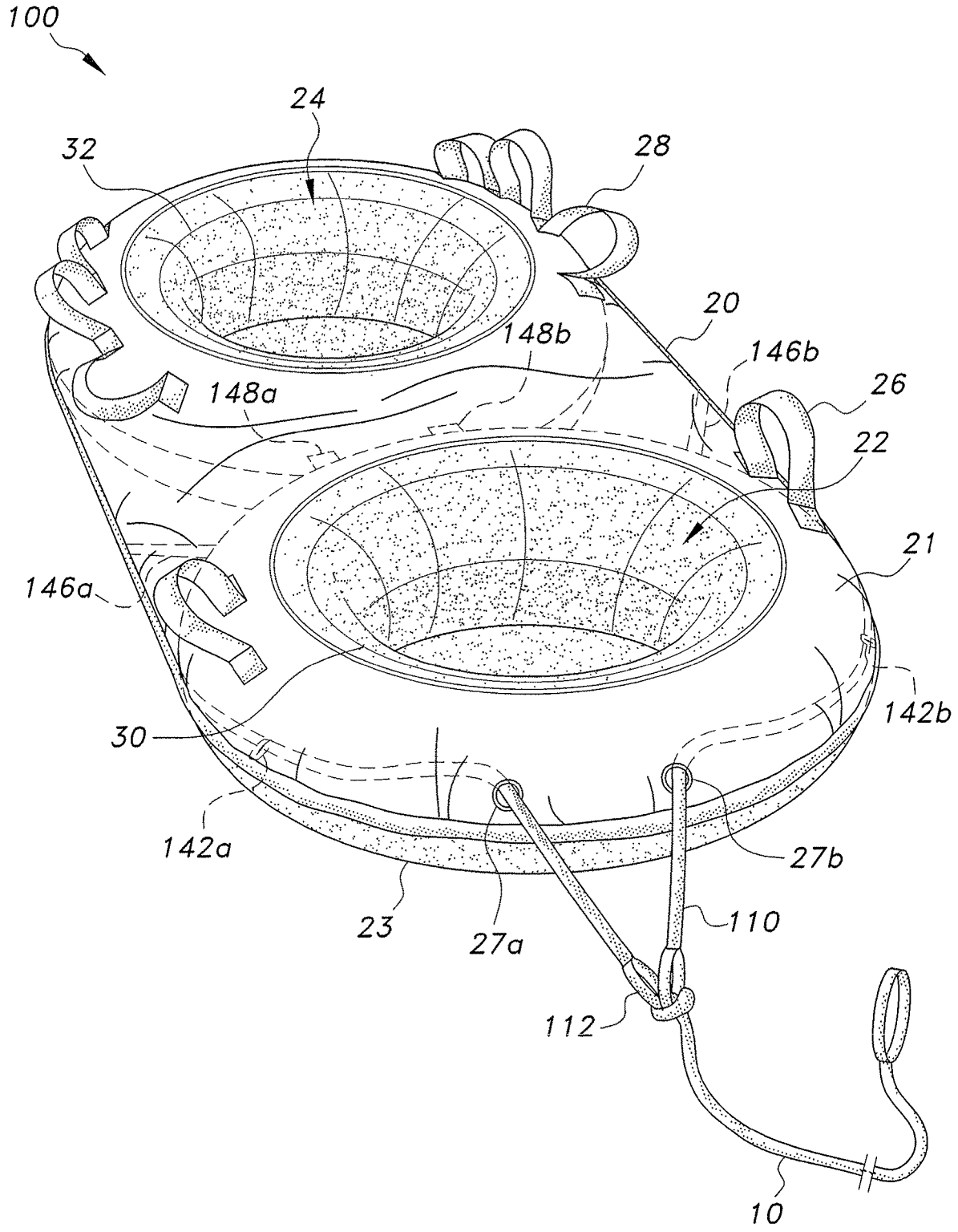
FIG. 1 is a perspective view of a towable device having a cover and looped tow strap.

FIG. 1 shows an embodiment of the towable device 100 containing two toroidal inflated tubes 30, 32. A front tube 30 and a back tube 32 may be arranged in a coplanar configuration with a portion of their circumferences contacting tangentially. A cover 20 covers both inflated tubes 30, 32 and is dimensioned and configured to hold the tubes lying on the sides in the desired coplanar position, i.e., in a row or column, when the tubes are inflated. The cover 20 is shaped to match the outer profile of the toroidal tubes 30, 32 and extend across the central passageways of the tubes 30, 32. A top surface of the cover 20 defines a front opening 22 positioned coaxial with the passageway defined by the front tube 30 and a rear opening 24 coaxial with the passageway defined by the back tube 24. Each opening 22, 24 may have a circular shape with a diameter greater than the narrowest portion of the tube's passageway and less than the outer diameter of the tubes 30, 32, preferably at the midpoint between the two diameters. The cover may be sized to tightly encase the tubes 30, 32 when the tubes 30, 32 are fully inflated.

The cover 20 may include an upper portion 21 and a lower portion 23, each shaped as an oval, that are joined at their perimeter by sewing, welding, or other methods known in the art. In some non-limiting embodiments, the seam between the upper and lower portion 21, 23 may be reinforced by webbing that runs around the interior of the seam. Each portion 21, 23 may be made from durable materials such as vinyl, polypropylene, polymer laminates, robust fabric, or any flexible, abrasion and puncture-resistant material. The material of the lower portion 23 may have a slick outer surface to minimize friction and enhance sliding over snow, water, or other similar surfaces. The outer surface of the lower portion 23, or generally a lower surface of the cover 20, may be coated with a friction modifying material, such as polytetrafluoroethylene, to further decrease friction when sliding. The upper portion may include handles 26 and 28 adjacent the openings 22, 24 for a rider to hold.

Figure 2:
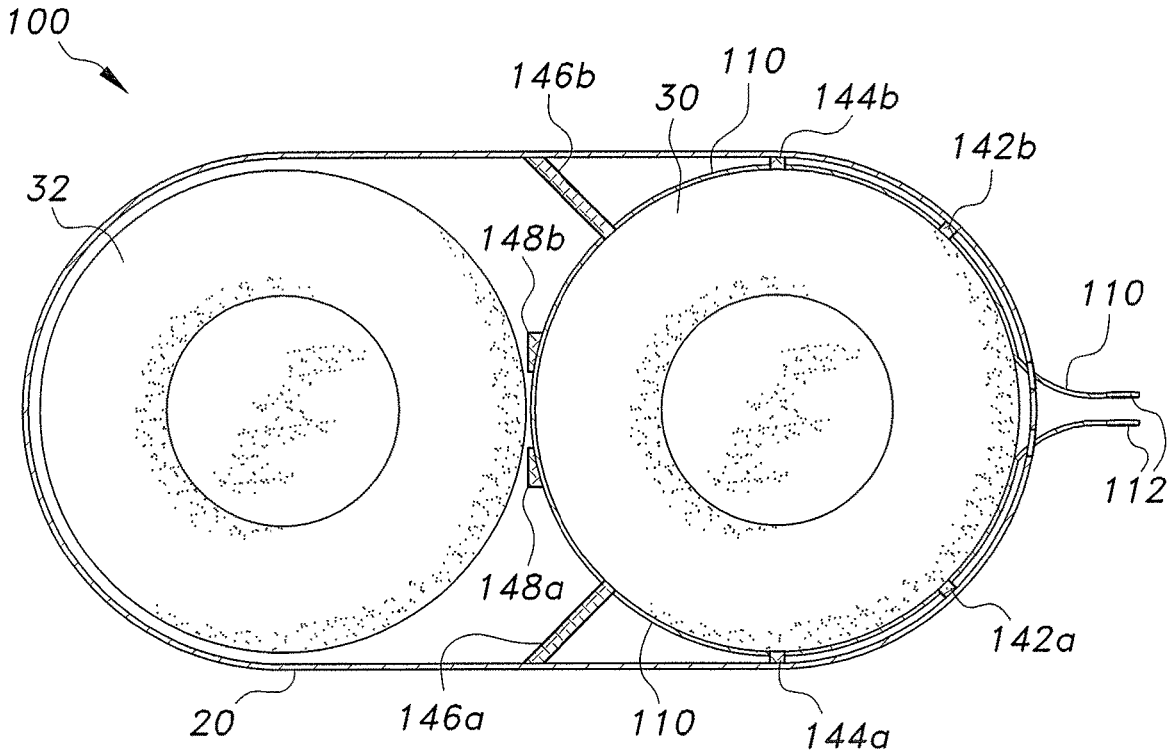
FIG. 2 is a top view in section of a first embodiment of the towable device of FIG. 1 having the tow strap looped around only the first inflatable tire in a sequence of tires enclosed by the cover.

FIG. 2 shows a cross-section of the towable device 100 of FIG. 1 at the seam of the cover 20, which details a single loop embodiment of a tow strap 110. The tow strap 110 extends into the cover through a left eyelet 27*b*, located at the front of the cover (see FIG. 1), wraps around the circumference of the front tube 30, and then exits the cover at right eyelet 27*a* positioned next to the left eyelet 27*b*. The end of the cover 20 where the ends of the tow strap emerge from the cover may be termed the towing end or front end of the cover 20, and the opposite end may be termed the back end of the cover 20. The tow strap 110 may be threaded through multiple guides 142*a*, 142*b*; 144*a*, 144*b*; 146*a* 146*b*; and 148*a*, 148*b* inside the cover 20. The guides may be connected to the cover 20 at a position that will be at a mid-height of the fully inflated tubes 30, 32. Accordingly, when strung through the guides 142*a*, 142*b*; 144*a*, 144*b*; 146*a*, 146*b*; and 148*a*, 148*b*, the tow strap 110 may be secured at a height so it wraps around the inflated tubes 30, 32 at their widest point. The gap seen in FIG. 2 between the perimeter of the tube 30 and the cover 20 is shown for clarity only. When the tube 30 is fully inflated, the tow strap 110 will be tightly sandwiched between the tube 30 and the cover 20, or between the tubes 30, 32 at the rear of the front tube 30. The sandwiching of the tow strap 110 between components will further secure the tow strap 110 in a set or fixed position. Each end of the tow strap 110 may include a loop 112 for connection to a tow rope 10, as seen in FIG. 1. The tow strap 110 may be made from a strong, flexible material that is resistant to stretching along it length, such as braided rope, nylon webbing, or the like.

The guides 142*a*, 142*b*; 144*a*, 144*b*; and 146*a*, 146*b* around the periphery of the cover 20 may be connected to webbing at the seam of the top 21 and bottom cover 23, or to the bottom cover 23 alone, and/or to the top cover 21 alone. The rear guides 148*a*, 148*b* may be connected to the top cover 21. The guides 146*a*, 146*b* at the rear flanks of the front tube 30 may extend out from the cover 20 to hold the tow strap 110 at a midpoint between the side guides 144*a*, 144*b* and the rear guides 148*a*, 148*b*.

The guides 142*a*, 142*b*; 144*a*, 144*b*; 146*a*, 146*b*; and 148*a*, 148*b* may be made by creating loops with high strength flexible material or textile, such as seatbelt webbing. For example, the front four guides 142*a*, 142*b* and 144*a*, 144*b* may be made by attaching both ends of a strip of guide material to the cover 20 with a central portion unattached and bulging out to create a channel for accepting the tow strap 110. The rear flank guides 146*a*, 146*b* and back guides 148*a*, 148*b* may be made by connecting one end of a strip of guide material to the cover 20 and connecting the opposing end to itself to create a loop for accepting the tow strap 110. A length between the loop and portion attached to the cover 20 for the rear guides 148*a*, 148*b* and rear flank guides 146*a*, 146*b* may be determined based on a distance between their origin and the desired portion of the front tube 30 when both tubes 30, 32 are fully inflated. The loops of the front four guides 142*a*, 142*b* and 144*a*, 144*b* may be sized just large enough to easily accept the tow strap 110 but not so slack that they may allow the tow strap 110 to move out of position. The rear flank guides 146*a*, 146*b* may have a length long enough to reach a mid-height of the inflated tube 30 at a midpoint between the side guides 144*a*, 144*b* and the rear guides 148*a*, 148*b*. The rear guides 148*a*, 148*b*, which may extend down from the top of the cover 20, may be sized to extend down to a mid-height of the tubes 30, 32 when the tubes 30, 32 are fully inflated. When the tubes are fully inflated and the tow strap 110 is secured through all the guides 142*a*, 142*b*; 144*a*, 144*b*; 146*a*, 146*b*; and 148*a*, 148*b*, the position of the tow strap 110 will be maintained at a mid-height of the tube 30 by the guides 142*a*, 142*b*; 144*a*, 144*b*; 146*a*, 146*b*; and 148*a*, 148*b* and compression between the tube 30 and cover 20, or between the tubes 30, 32. The rear guides 148*a*, 148*b* may prevent the tow strap 110 from entering the user-occupied area of the front tube 30 in situations where the tow strap 110 has slackened or been jerked. Through wrapping around the tube 30, forces from the tow strap 110 will be dispersed throughout the towable device 100.

Figure 3:
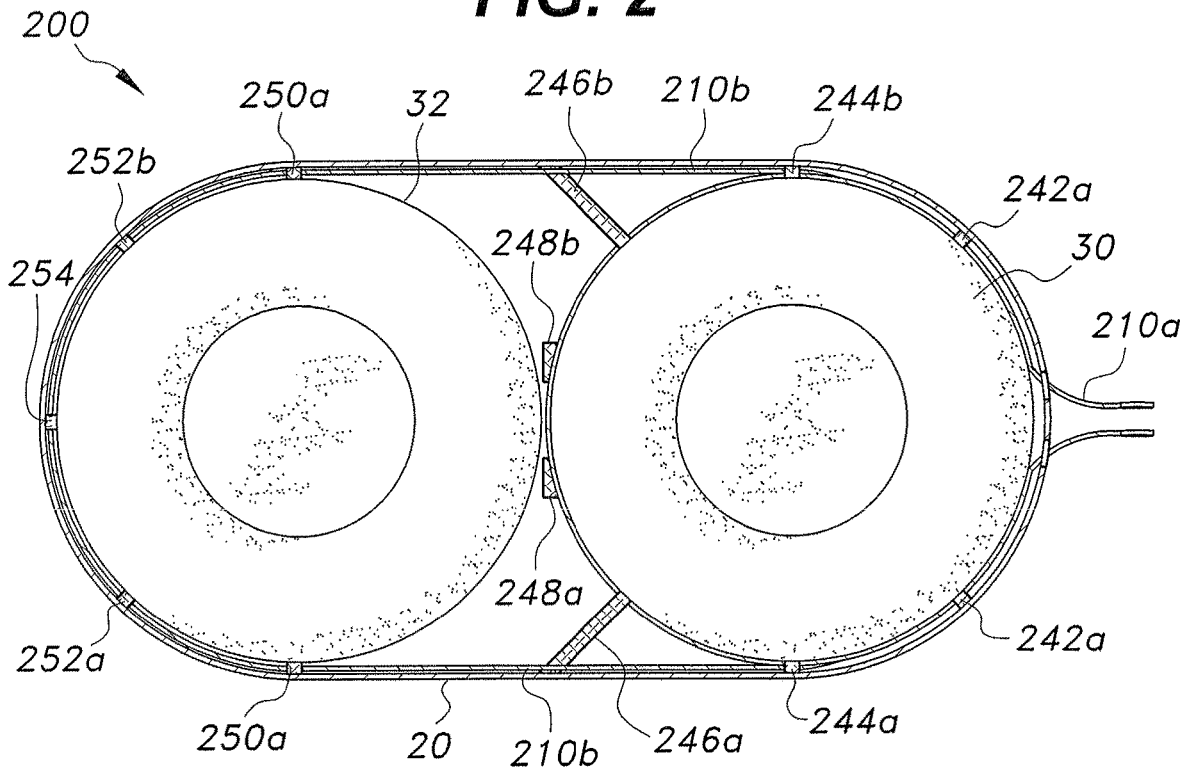
FIG. 3 is a top view in section of an embodiment of the towable device of FIG. 1 having a tow strap forming successive loops around both first and second inflatable tires in a sequence of tires enclosed by the cover.

FIG. 3 shows a cross-section of a second embodiment of a towable device 200, showing a double loop embodiment of the tow strap 210*a*, 210*b*. This embodiment includes a first loop 210*a* similar to the tow strap 110 shown in FIG. 2, including guides 242*a*, 242*b*; 244*a*, 244*b*; 246*a*, 246*b*; and 248*a*, 248*b* similar to the guides 142*a*, 142*b*; 144*a*, 144*b*; 146*a*, 146*b*; and 148*a*, 148*b* shown in FIG. 2. A second loop 210*b* may be attached to the first loop 210*a* at the widest points of the first loop 210*a*, which will be the points where the first loop 210*a* begins to extend inwards from the cover 20. The second loop 210*b* will then follow the edge of the cover 20 back to the rear tube 32, and extend around the rear tube 32 at the same mid-height position as the loop 210*a* around the first tube 30. Guides 250*a*, 250*b*; 252*a*, 252*b*; and 254 connected to the cover 20 at its rear may be used to maintain the position of the rear loop 210*b*.

Figure 4:
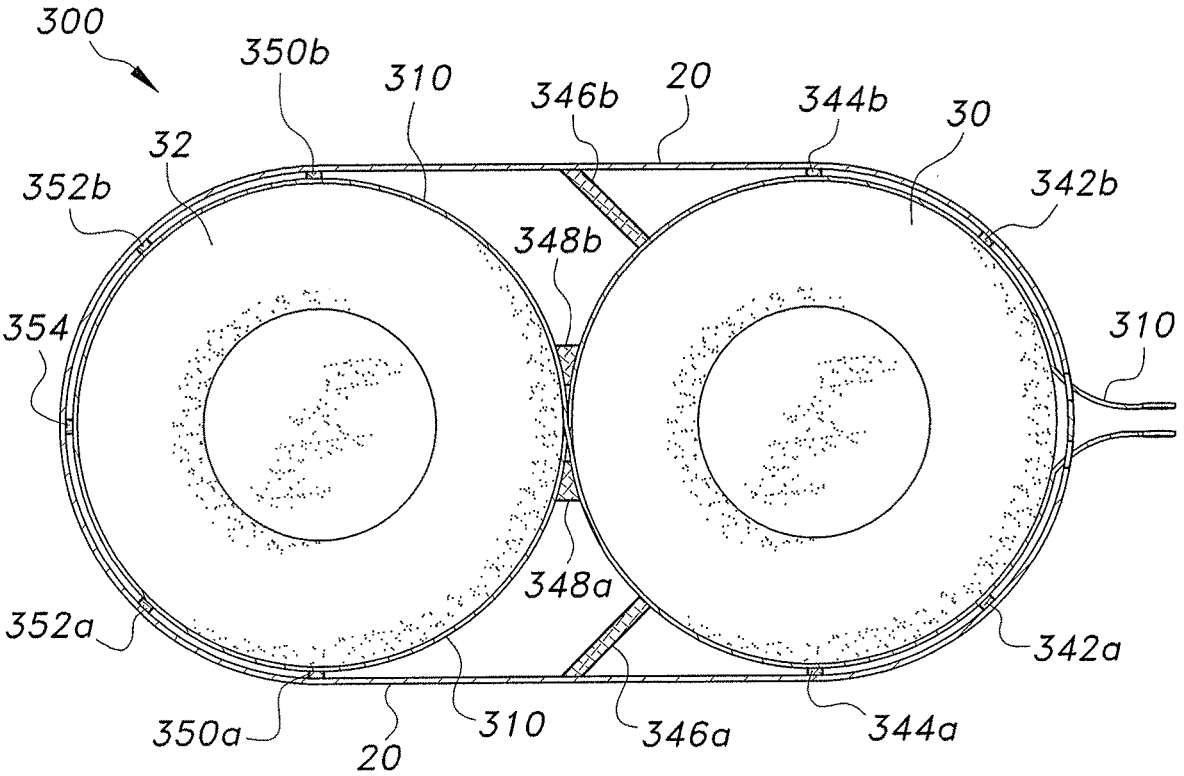
FIG. 4 is a top view in section of an embodiment of the towable device of FIG. 1 having the tow strap wrapped around both first and second inflatable tires in "FIG. 8" fashion.

FIG. 4 shows a cross-section of a third embodiment of a towable device 300, showing a figure-eight embodiment of a tow strap 310. In this embodiment, the tow strap 310 extends into the cover 20 through a left eyelet 27*b* located at the front of the cover 20. The tow strap 310 then wraps around each tube 30, 32 in a figure-eight pattern by first wrapping clockwise around a left side of the front tube 30 until the front tube 30 and second tube 32 meet (from about 90° to about 270° in the orientation of FIG. 4, then wrapping counterclockwise around a complete circumference of the rear tube 32, and finally extending between the tubes 30, 32 and clockwise around the right side of the front tube 30 (from about 270° to 90° in the orientation of FIG. 4) and extending out of the cover 20 through a right eyelet 27*a*. The inner surface of the cover 20 may include guides 342*a*, 342*b*; 344*a*, 344*b*; 346*a*, 346*b*; 348*a*, 348*b*; 350*a*, 350*b*; 352*a*, 352*b*; and 354, which are similar to the guides 242*a*, 242*b*; 244*a*, 244*b*; 246*a*, 246*b*; 248*a*, 248*b*; 250*a*, 250*b*; 252*a*, 252*b*; and 254 of the embodiment of FIG. 3, in which the tow strap 310 is strung through for securing the tow strap 310 in a position around the circumference of the tubes 30, 32 during inflation and use.

In some embodiments, the towable devices 100, 200, and 300 may include more than two toroidal tubes, so that the additional tubes added front-to-back in linear sequence with the tubes 30, 32 shown in FIGS. 1-4. The tow strap 210, 310 shown in the embodiments in FIGS. 3 and 4 may extend back around multiple tubes in the same manner they extend around two tubes. If the double loop tow strap embodiment of FIG. 3 is used for a towable device having three tubes, a third loop may be added to the back of the second loop. If a third tube is added to the "figure eight" tow strap embodiment of FIG. 4, the figure eight pattern of the tow strap will cross over at the rear of the middle tube and then extend clockwise around the third tube. Similarly, guides will be added for the additional tubes in the same position relative to the tubes shown in FIGS. 3 and 4 to secure the tow strap around a circumference of the tubes at a mid-height position.

Figure 5:
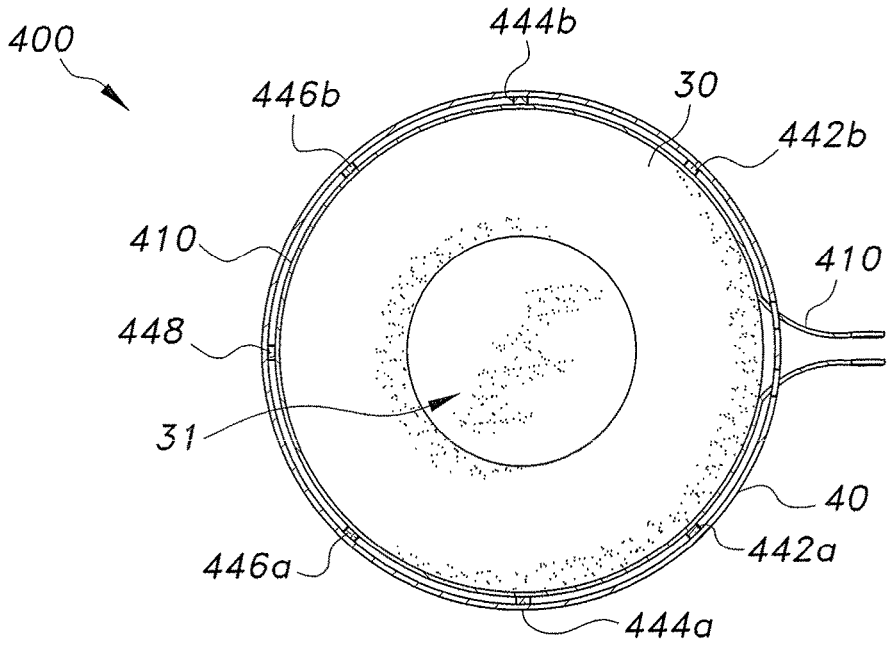
FIG. 5 is a top view in section of an alternative embodiment of a towable device having a cover and looped tow strap having a single inflatable tire, the tow strap being looped around the single inflatable tire.

FIG. 5 shows a cross-section of an embodiment of the towable device 400 having a single inflatable tube 30. Similar to the other embodiments, the cover 40 wraps around the tube 30 and defines an opening in its top surface which aligns with the passageway 31 in the center of the tube 30. The tow strap 410 wraps around a circumference of the tube 30 within the interior of the cover 40. Guides 442*a*, 442*b*; 444*a* 444*b*; 446*a*, 446*b*; and 448 may be used to hold the tow strap 410 at a mid-height position of the tube 30 when the tube 30 is fully inflated.

It is to be understood that the towable device having a cover and looped tow strap is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A towable device, comprising:

at least two toroidal shaped inflatable tubes including a front tube and a rear tube, each of the tubes having a central passageway;

a cover encasing the tubes in a coplanar, horizontal, and linear configuration, the cover having an upper portion defining a passenger opening for each of the tubes, the passenger openings being aligned with the central passageway of each of the tubes, respectively, the cover having a front, towing end and an opposite back end;

a plurality of guides spaced around within the cover;

a tow strap, the tow strap extending through the guides and wrapping around an outer circumference of at least one of the tubes; and two eyelet holes defined in the front towing end of the cover, the tow strap being elongated and having opposing ends, each of the ends of the tow strap extending out of the cover through a respective one of the eyelets.

2. The towable device of claim 1, wherein each of the guides defines a loop through which the tow strap extends.

3. The towable device of claim 1, wherein the cover comprises a lower portion, the upper portion and the lower portion each being elliptical and having an outer perimeter, the lower portion and the upper portion being joined together along their outer perimeters.

4. The towable device of claim 3, wherein at least two of said guides are connected to the cover at a junction between the upper and lower portions.

5. The towable device of claim 1, wherein the guides are configured to hold the tow strap around the widest circumference of each said tube when said tubes are inflated.

6. The towable device of claim 1, wherein the tow strap is configured in a figure-eight pattern around the tubes, alternately winding around the tubes clockwise and counterclockwise.

7. The towable device of claim 1, wherein the tow strap includes multiple connected loops, each of the loops being wrapped around a separate one of said at least two tubes.

8. The towable device of claim 1, wherein the tow strap extends around the circumference of the first tube.

9. The towable device of claim 1, wherein the cover has a smooth lower outer surface configured to accommodate sliding.

10. The towable device of claim 1, further comprising at least one set of handles for each of said at least two tubes, the handles being attached to the upper portion of the cover adjacent the passenger openings.

11. The towable device of claim 1, wherein:

the front tube has a front half adjacent the front end of the cover and a rear half;

the plurality of guides includes two front guides located at the front half of the front tube, two side guides located at a midpoint between the front half and the rear half of the front tube, two rear flank guides extending out from the cover for attachment to a portion of the tow strap adjacent the rear half of the tube at a location removed from the cover, and at least one rear guide extending out from the cover for attachment to a portion the tow strap adjacent the rear half of the tube at a location removed from the cover.

12. The towable device of claim 11, wherein the guides are configured to hold the tow strap around the widest point of the front tube when inflated.

13. A towable device, comprising:

at least one toroidal inflatable tube;

a cover encasing the at least one tube, the cover having an upper portion defining a passenger opening for the at least one tube, the passenger opening being aligned with a central passageway defined by the at least one tube, the cover having a front, towing end and an opposite back end;

a plurality of guides connected and dispersed around within the cover;

a tow strap, the tow strap extending through the guides and wrapping around an outer circumference of the at least one tube; and two eyelet holes defined in the front towing end of the cover, the tow strap being elongated and having opposing ends, each of the ends of the tow strap extending out of the cover through a respective one of the eyelets.

14. The towable device of claim 13, wherein the guides define loops, the tow strap extending through the loops.

15. The towable device of claim 14, wherein the at least one tube has a widest point when inflated and the guides are configured to hold the tow strap around the widest point of the at least one tube when inflated.

16. The towable device of claim 5, wherein the two eyelets are located at the mid-height of the widest circumference of the front tube when said tubes are inflated.

17. The towable device of claim 15, wherein the two eyelets are located at the mid-height of the widest circumference of the at least one tube when inflated.

* * * * *